US005852891A

United States Patent [19]

Onishi et al.

[11] Patent Number: 5,852,891

[45] Date of Patent: Dec. 29, 1998

[54] GUN TRIGGER ASSEMBLY

[76] Inventors: Masamichi Onishi, 14-1 Ebisu-Nisi 2 chome Naniwaku; Hideyuki Nakatani, 14-1 Ebisu-Nisi 2 chome Naniwaku, both of Osaka, Japan

[21] Appl. No.: 878,010

[22] Filed: Jun. 18, 1997

[51] Int. Cl.[6] ..... F41A 19/10; F41A 19/12; F41A 19/13

[52] U.S. Cl. ..... 42/69.01; 89/136; 89/132

[58] Field of Search ..... 42/69.02, 69.01; 89/136, 132

[56] References Cited

U.S. PATENT DOCUMENTS

| | | | |
|---|---|---|---|
| 1,240,068 | 9/1917 | Lytton | 42/69.02 |
| 2,249,231 | 7/1941 | Smith | 42/69.02 |
| 2,249,232 | 7/1941 | Smith | 42/69.02 |
| 4,671,005 | 6/1987 | Jewell | 42/69.02 |
| 4,908,970 | 3/1990 | Bell | 42/69.02 |
| 5,187,312 | 2/1993 | Osborne | 42/69.01 |
| 5,363,581 | 11/1994 | Blenk et al. | 42/69.02 |

FOREIGN PATENT DOCUMENTS

| | | | |
|---|---|---|---|
| 10492 | 7/1909 | France | 42/69.02 |
| 75594 | 6/1961 | France | 42/69.02 |
| 506922 | 9/1930 | Germany | 42/69.02 |
| 4125148 | 2/1993 | Germany | 42/69.01 |

*Primary Examiner*—Stephen M. Johnson

[57] ABSTRACT

An exceedingly simple, logical, and reliable trigger assembly that allows the trigger to release smoothly with very little applied force. The present invention provides an improved, exceedingly unencumbered trigger apparatus for guns utilizing the resistant force of a spring to drive a firing pin or piston. This novel trigger assembly employs a fluid movement of simply interrelated parts to fire a gun. The invention basically comprises a pivotally moving sear having multiple pivot pins, one of which is sequentially connected to multiple linkages also having multiple pivot pins. When the trigger assembly is in a state of engagement, the sear is perpendicular to the linkages. By actuation of the trigger, the horizontal alignment of the linkages relative to one another is slightly broken, resulting in the upset of the perpendicular alignment of the sear relative to the linkages through the multiple pivots. The interrelated movement of the trigger, linkages, and sear results in release by the sear of a spring-loaded firing pin or piston, firing the gun, The invention can be applied to rifles, air rifles, air hand guns, paint ball guns, toy guns and the like and can be attached to or removed from a gun with great ease.

7 Claims, 3 Drawing Sheets

GUN TRIGGER ASSEMBLY

References Cited

US PATENT DOCUMENTS

| | | |
|---|---|---|
| 4671005 | 6/1987 | Jewell |
| 4908970 | 3/1990 | Bell |
| 5187312 | 2/1993 | Osborne |

BACKGROUND OF THE INVENTION

In the development of gun technology, numerous gun trigger systems have been devised. To effect trigger release using very little force has necessitated the use of complicated devices. For instance, the typical mechanical triggers of guns used in sporting events have consisted of a large number of parts. Other trigger inventions exist; for example, U.S. Pat. No. 4,671,005 (Jewell), U.S. Pat. No. 4,908,970 (Bell), and U.S. Pat. No. 5,187,312 (Osborne). Yet, compared to the present invention, the above inventions are generally expensive to produce and require a relatively high level of machining technology and technical knowledge of manufacturing.

In recent years, rifle, hand gun, and air gun competition sports have become very popular. Representative of such sport events is the Olympics. The point of such an event typically is to shoot a series of projectiles so as to concentrate them at the center of a target. However, when aiming a gun equipped with such a system, at times a loss of alignment between gun sights (the barrel) and target occurs because the trigger is pulled with improper force due to the construction of commonly used trigger systems, resulting in a loss of accuracy. An improved trigger apparatus providing a logical system of components actuated by a slight degree of force, making for smooth and easy trigger operation, would be ideal for competitive sports and any other instance in which accuracy as well as dependibility count.

The present invention achieves this ideal for guns that utilize the resistant force of a spring to drive a firing pin or piston. The invention enables trigger actuation to be effected using a relatively small amount of applied force. This trigger assembly works well, for example, in air guns, which are generally noted for their difficult trigger-pull qualities if equipped with a strong internal firing spring.

The arrangement of the components of the trigger assembly herein was designed to greatly reduce the amount of frictive resistance occurring between components. This invention provides a trigger assembly with a logical system of components activated using minimal force, making sport rifles, air guns, and toy guns among other guns more enjoyable, accurate, and efficient.

SUMMARY OF THE INVENTION

The present invention generally relates to guns firing a center- or rim-fire cartridge discharged by a firing pin which utilizes the force of a spring. The invention also relates to air rifles, air hand guns, paint ball guns and the like, including those of the spring-powered type which fire a projectile utilizing the acceleration of a piston through a cylinder which creates a momentary evacuation of high-pressure air.

The gun trigger assembly detailed herein employs a basic, novel organization of components which greatly minimizes the amount of work required of each component and efficiently maintains the integrated motion of the various components. Other improvements offered by the trigger assembly herein include trigger actuation using minimal force and ready application to spring-loaded firing pin as well as firing piston type guns. The invention basically comprises a pivotally moving sear having multiple pivot pins, one of which is connected to multiple linkages also having multiple pivot pins.

When the trigger assembly is engaged, the sear is perpendicular to the linkages. The sear in the engaged position holds in place a spring-loaded firing pin or piston block due to the stabilizing force of linkages perpendicular to the sear and themselves stablized in horizontal alignment by the arrangement of link pins and by a spring attached to the linkage farthest from and indirectly connected to the sear. The sear has a cross pin anchored in the trigger assembly cover and a link pin which connects the sear to a linkage extending to at least one other, spring-held linkage which extends towards and interacts with a trigger or triggering mechanism.

The sear holds the firing block in place until trigger actuation pivotally moves the linkage which is indirectly connected to the sear, causing a slight loss of horizontal equilibrium between the linkages at the shared axis their link pins. As a result, simultaneous to this loss of equilibrium of the linkages at a horizontal center line, the vertically aligned sear forwardly rotates, firing the gun.

Figure 1:
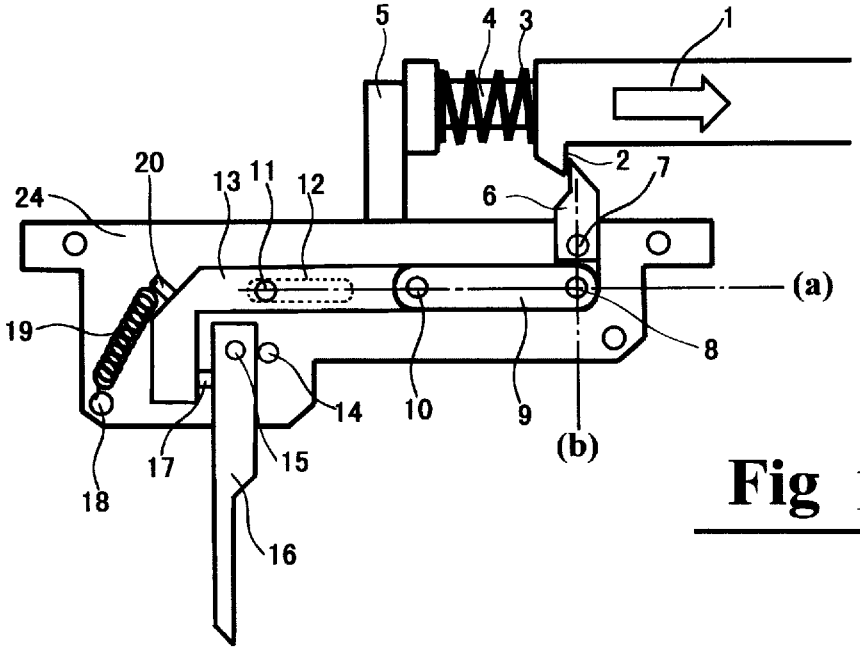
FIG. 1 is a right side cross-sectional view illustrating the position of the various components of the preferred embodiment of the present invention in an engaged, pre-firing state.

The parts listed below are correlated by number and name throughout FIGS. 1–6.

1 Firing Block (Block)
2 Articulation Site
3 Block Spring
4 Block Spring Guide
5 Block Spring Guide Stopper
6 Sear
7 Sear Cross Pin
8 Sear Link Pin
9 Sear Linkage
10 Link Pin
11 Guide Pin
12 Guide Opening
13 Linkage
14 Trigger Stop
15 Trigger Pin
16 Trigger
17 Trigger Assist Bar

18 Spring Set Pin
19 Linkage Spring
20 Spring Set Screw
21 Front Fastener Block
22 Rear Fastener Block
23 Trigger Assembly
24 Cover
25 Cover
26 Front Fastener
27 Rear Fastener
28 Cover Screw
29 Cover Screw
30 Cover Screw
31 Cover Screw
(a) Horizontal Center Line
(b) Vertical Center Line

DETAILED DESCRIPTION

What follows is a detailed description of the operation of the preferred embodiment of the trigger assembly in reference to the drawings. The trigger assembly of FIGS. 1–4 is attached underneath a retractable firing piston unit of a typical spring-powered air gun, illustrating an application of the invention. The firing piston (referred to as firing block 1) is released at sear 6 by means of the manual actuation of trigger 16. Firing block 1 is cylindrical and houses block spring 3, which is guided by block spring guide 4 and applies forward pressure on firing block 1.

In FIG. 1, link pin 10, set by sear linkage 9, sear link pin 8, guide pin 11, and linkage 13, combines with linkage 13, spring set screw 20, and linkage spring 19 (connected to spring set pin 18) to provide the basis on which linkage 13 is placed in a rearwardly and downwardly secured position. Guide pin 11 then acts as a fulcrum for linkage 13. Accordingly, link pin 10 is aligned to center line (a); however, it is acceptable for link pin 10 to maintain linkage 13 and sear linkage 9 in an inverted "V" position of 0.2–0.3 mm or so above center line (a). The position of guide pin 11 is stabilized towards the rear of guide opening 12 by linkage spring 19.

Figure 4:
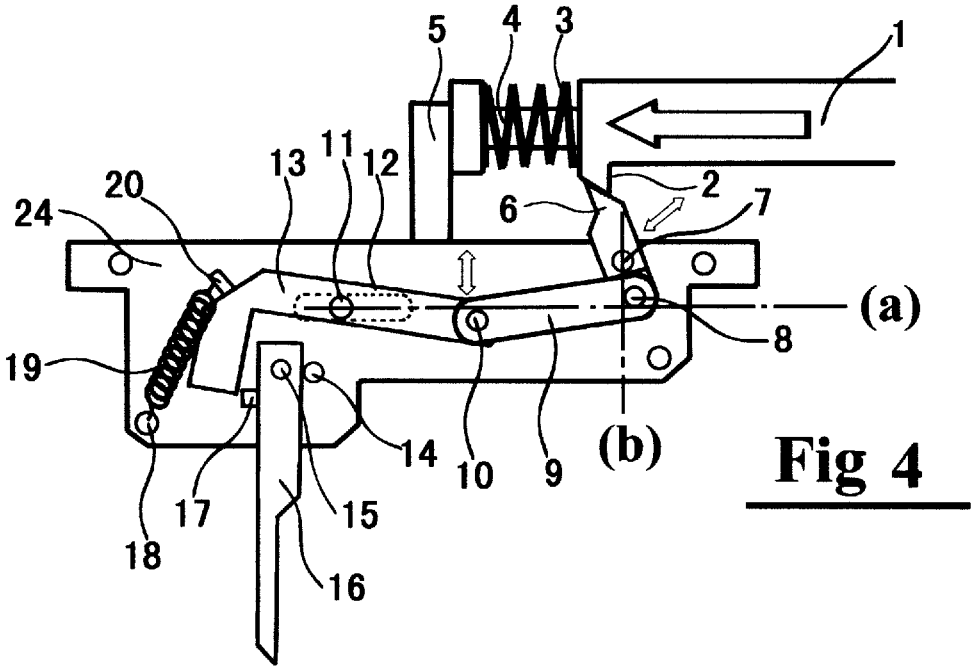
FIG. 4 shows the basic movement of the various, articulating components of FIG. 1 when the sear and the firing block are entering the engaged position of FIG. 1.
Figure 5:
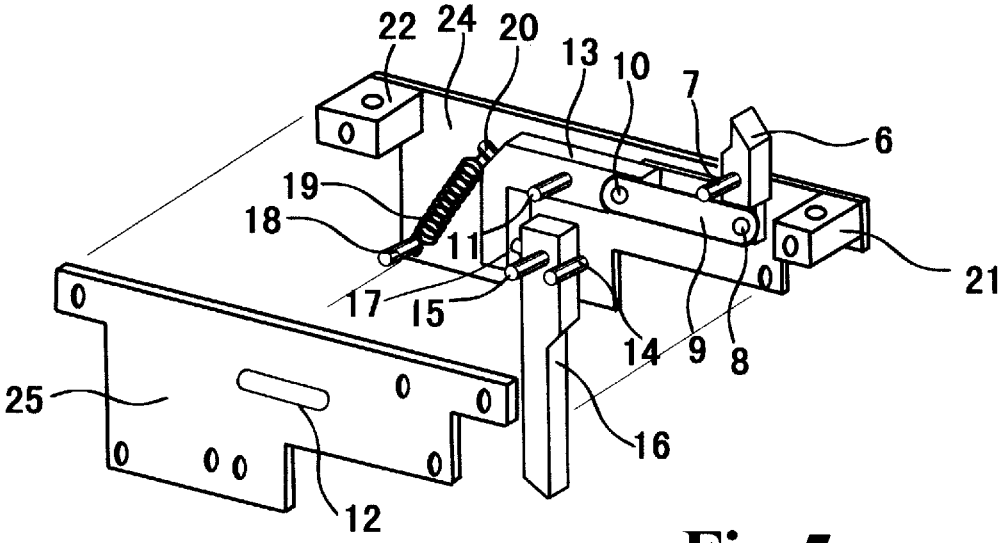
FIG. 5 shows a right side oblique view of the preferred embodiment of the trigger assembly of the present invention, including a cross-section of the relevant portion of FIG. 1 and a separated cross-section of the transverse cover of the relevant portion of FIG. 1.

Guide opening 12 is an oblong aperture in cover 24 (FIGS. 1–4) and cover 25 (FIG. 5). Guide opening 12 ensures a space by which guide pin 11 and linkage 13 can move forward and backward. Guide opening 12 is located such that sear link pin 8, link pin 10, and guide pin 11 can form a straight line at center line (a) along the horizontal axis of sear link pin 8 and link pin 10, as seen in FIG. 1.

Referring to FIG. 1, forward movement of trigger 16 is regulated by trigger stop 14 such that only rearwardly movement of trigger 16 is possible. Trigger assist 17 is attached to trigger 16. The length of trigger assist 17 is adjustable. Trigger assist 17 articulates with linkage 13, being in contact at the time of initial disengagement of sear 6. The shaded components of FIG. 1, comprising sear cross pin 7, trigger stop 14, and trigger pin 15, are held in place by cover 24 and cover 25 (FIG. 5).

Figure 2:
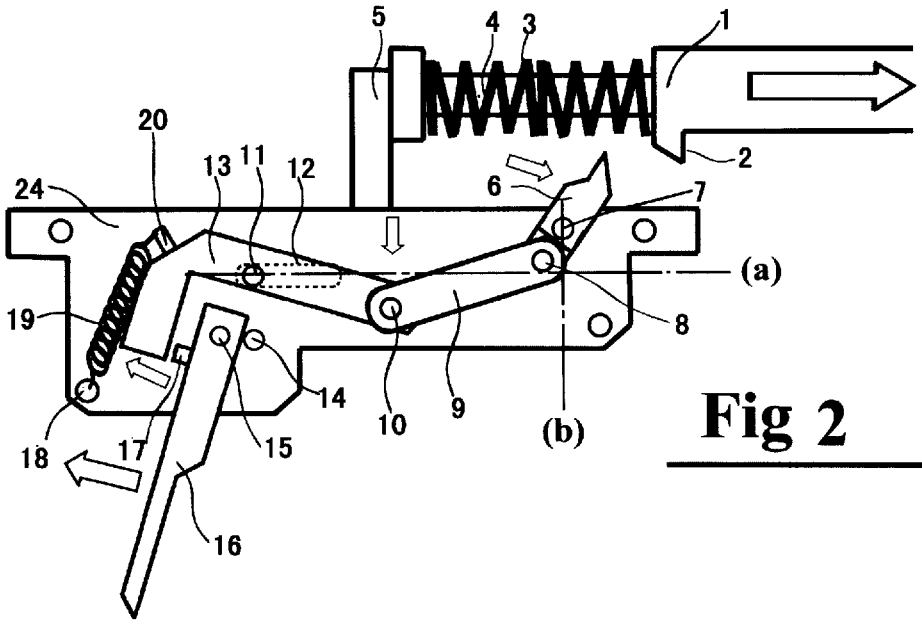
FIG. 2 shows the position of the various components of FIG. 1 immediately after disengagement.

Referring to FIGS. 1 and 2, the operation of the trigger assembly will be explained below. In reference to FIG. 1, sear 6, sear link pin 8, sear linkage 9, link pin 10, and the horizontal portion of linkage 13 are connected and arranged in relation to perpendicular center lines (a) and (b) in such a way that sear 6 is perpendicular to sear linkage 9 and the horizontal portion of linkage 13 when sear 6 is engaged. Firing block 1 is directly held in place by sear 6 at articulation site 2. The position of sear 6 is fundamentally regulated by sear link pin 8. Stabilization of sear 6 into a locked position along vertical center line (b) is effected by the relation of sear 6 to the stable alignment on center line (a) of the horizontal axis of sear link pin 8, link pin 10, and guide pin 11. Disengagement of firing block 1 and sear 6 at articulation site 2 only requires the force needed to upset the equilibrium of the components arranged along horizontal center line (a), to which center line (b) of sear 6 is relationally perpendicular. Link pin 10 arranged along horizontal center line (a) in FIG. 1, moves downwardly during disengagement, slightly losing equilibrium in relation to horizontal center line (a) in FIG. 2. In this manner, the outcome of the triggered movement of the chain of linkages and pins of FIG. 1 is the loss of the perpendicular alignment of the linkages and pins arranged along center lines (a) and (b), resulting in the forward pivoting of sear 6 which releases firing block 1 under the force of block spring 3, firing the gun. By pulling rearwardly on trigger 16 when sear 6 is in the engaged state of FIG. 1, the various interconnected parts of the gun assembly move in relation to one another, as illustrated in FIG. 2.

Referring to FIG. 2, when trigger 16 is rearwardly pulled, trigger assist 17 presses against linkage 13. Accordingly, linkage 13, while receiving downward resistance from linkage spring 19, pivots in a clockwise motion, guide pin 11 acting as fulcrum. At the clockwise motion of linkage 13, link pin 10 moves downward, and linkage 13 and sear linkage 9 form a "V" shape. At the same time, when the activated, interrelational motion from trigger 16 to trigger assist 17 to linkage 13 to sear linkage 9 takes place, the alignment of the vertical axis of sear link pin 8 and sear cross pin 7 on center line (b) collapses. Since sear link pin 8 has moved off of center line (b), sear 6 begins to advance in a clockwise direction, pivoting on sear cross pin 7. When sear 6 is released to rotate in a clockwise direction with sear cross pin 7 acting as fulcrum, the speed of the rotation of sear 6 is immediately, powerfully increased by the released force of firing block 1 at articulation site 2 just released by sear 6. At this point in the operation of the trigger assembly, sear 6 and firing block 1 begin to separate from firing block 1 at articulation site 2, sear 6 pivoting clockwise vigorously. Accompanying the movement of sear 6, link pin 10 moves further in a downward direction through sear linkage 9 due to the movement of sear link pin 8 in a clockwise direction Accompanying the movement of link pin 10, linkage 13, taking guide pin 11 as fulcrum, moves foward in a clockwise direction while encountering resistance from linkage spring 19.

Figure 3:
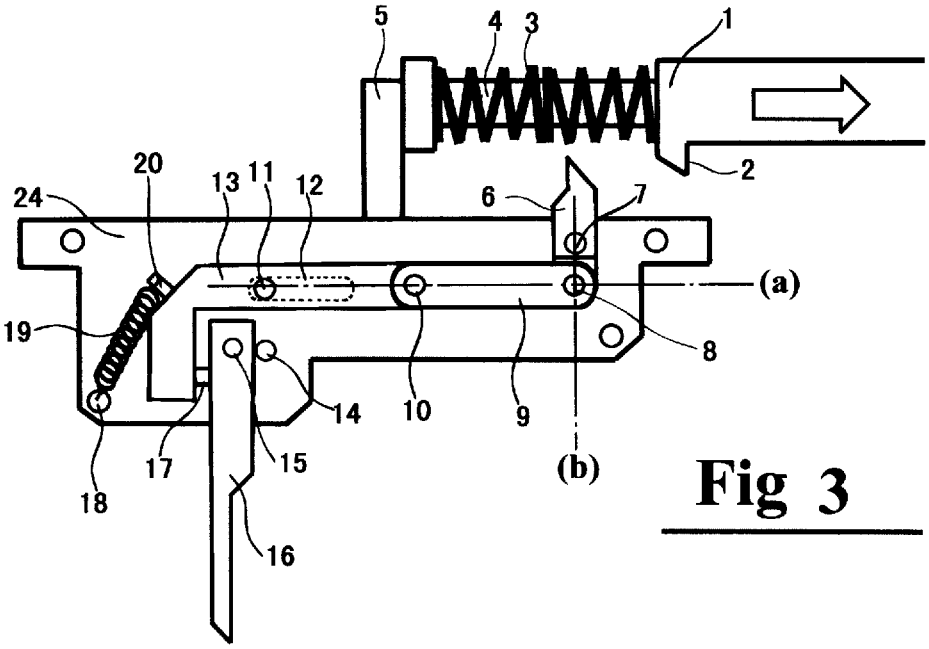
FIG. 3 shows the recovery movement of the various components of FIG. 1 after disengagement.

Referring to FIG. 3, after actuation of trigger 16 and disengagement as seen in FIG. 2, the bias applied to linkage 13 by linkage spring 19 helps the trigger assembly linkages and sear 6 automatically to return to the engaged position. Also, referring to FIG. 2, by changing the amount of force applied by spring 19, the force required to pull trigger 16 can be adjusted. Furthermore, by changing the protruding length of trigger assist bar 17, the stroke of trigger 16 is adjustable.

In order to test the efficacy of the trigger mechanism, experiments 1 and 2 discussed below were carried out. Referring to FIG. 1, in experiment 1, the force of block spring 3 in firing block 1 was set at 10 kg. Referring to FIG. 2, at this amount of forward pressure of firing block 1 against rigidly engaged sear 6, actuation of trigger 16 under a mere 60 g of rearward force was able to activate the forward pivoting movement of sear 6 through sear linkage 9 and linkage 13, resulting in the release of firing block 1. In experiment 2, the force of block spring 3 against engaged sear 6 was set at 15 kg. Actuation of trigger 16 under a mere 61–62 g of rearward force was able to activate the forward pivoting movement of sear 6. In comparing the experiments, although the amount of forward pressure against sear 6 in experiment 2 was 50% greater than the amount of pressure against sear 6 in experiment 1, experiment 2 required no more than a mere 2 g increase in the amount of force required to actuate trigger 16 to forwardly pivot sear 6 to release firing block 1.

As the above experiments indicate, the forward force of block spring 3 in firing block 1 can be successfully contained by sear 6 through the placement of the horizontal axis of sear link pin 8, link pin 10, and guide pin 11 along center line (a), serving to hold in place the vertical axis of sear link pin 8 and sear cross pin 7 along center line (b). Likewise, the forward force of block spring 3 in firing block 1 can be successfully released by sear 6 through the displacement of the horizontal axis of sear link pin 8, link pin 10, and guide pin 11 along center line (a), serving to displace the vertical axis of sear link pin 8 and sear cross pin 7 along center line (b).

FIG. 3 shows the normal condition of recovery of the trigger assembly after disengagement at articulation site 2 has been achieved but prior to the recompression of block spring 3. After the separation of sear 6 and firing block 1 at articulation site 2, at first sear 6 moves in a vigorous clockwise movement which results in the movement of linkage 13 in a clockwise direction. But at a certain point, the counterforce of linkage spring 19 at spring set screw 20 causes sear 6 and linkage 13 to rotate in a counterclockwise direction, linkage 13 taking guide pin 11 as fulcrum. At the end of this initial recovery stage, link pin 10, sear 6, and sear link pin 8 return to the positions shown in FIG. 3. At this time, firing block 1 is still advancing under the force of block spring 3 and being readied for the next operation.

FIG. 4 shows the operation of the trigger assembly as firing block 1 is being returned to its pre-firing condition as seen in FIG. 1. When firing block 1 is pulled backwards to recompress block spring 3, the tapered surfaces of sear 6 and firing block 1 at articulation site 2 come into contact and sear 6 rotates counterclockwise taking sear cross pin 7 as fulcrum. At the same time, sear link pin 8 and sear linkage 9 interrelationally shift, accompanying the movement of sear 6. Accompanying the shifting of sear link pin 8 and sear linkage 9, the position of guide pin 11 shifts to the right along guide opening 12. Taking the shifted, rightward position of guide pin 11 on guide opening 12 as fulcrum, the position of linkage 13 shifts in a clockwise direction and against the resistance of linkage spring 19. When sear 6 and firing block 1 are making full contact at articulation site 2, the components of FIG. 3 have returned to the condition shown in FIG. 1.

FIG. 5 is an oblique cross-sectional view of the basic components of the preferred embodiment of the invention. The components of the trigger assembly are made of a dense material. The materials of the movable parts of the preferred embodiment are made of dense metal. Concrete methods for constructing the preferred embodiment are machining and laser processing. Other methods which may be used include press production and casting. Some components may be made of engineered plastics.

Sear linkage 9 is made of two flat, rectangular pieces and serves to link together linkage 13, which is one solid piece, and sear 6 at sear link pin 8 and link pin 10. Concerning the connecting parts of the trigger assembly, because the diameters of the various linkage pins are smaller than their linkage pin apertures, the amount of frictive resistance occurring between linked parts is greatly reduced. Also, although the linkage pins of the drawings are cylindrical, other shapes are possible. Front fastener block 21 and rear fastener block 22 ensure the correct spacing between cover 24 and cover 25 and protect the operation of the various movable components from obstruction.

Figure 6:
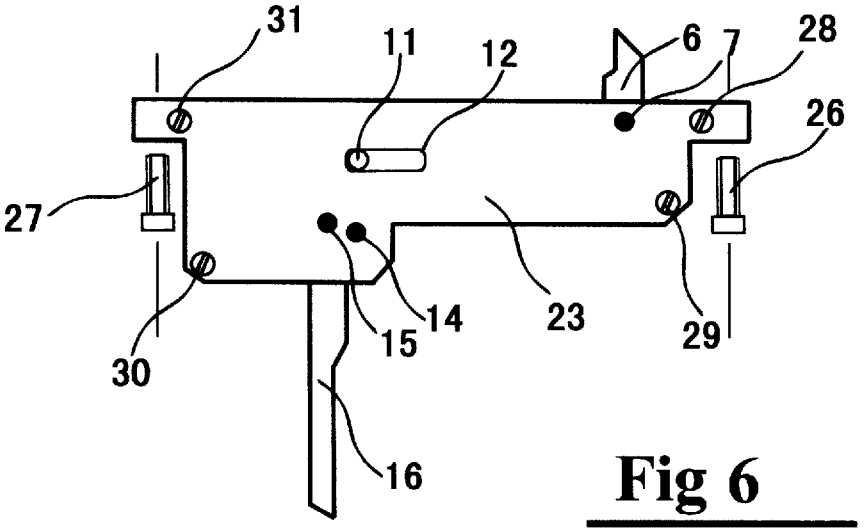
FIG. 6 is a right side elevational view of the preferred embodiment of the assembled trigger unit of the present invention.

FIG. 6 is a right side elevational view of the preferred embodiment. The trigger assembly can be freely mounted on or removed from the receiver of a gun using only two screws, front fastener 26 and rear fastener 27. Cover screws 28, 29, 30, 31 screw into and serve securely to hold together covers 24 and 25. The preferred embodiment illustrated herein does not illustrate a safety apparatus. However, a trigger safety may be applied in the actual use of the trigger assembly.

The drawings presented herein are intended to illustrate the preferred embodiment of the invention but they should not be considered a limitation of the present invention. Therefore, modifications, adaptations, or other changes concerning the illustrated art may fall within the spirit and scope of the present invention.

What is claimed is:

1. A gun trigger assembly freely mountable on an underside of a main body of a gun equipped with a spring-loaded retraclable firing pin and a triggering device, comprising:

a sear pivotally mounted, having an end engageable with said firing pin;

a first pivot pin fixedly mounted and extending through an aperture on said sear and serving as a fulcrum for said sear;

a first linkage having an end which shares a second pivot pin with said sear, and having an opposing end which shares a third pivot pin with a second linkage;

said second linkage indirectly connected to said sear through said first linkage and having spring means and able to interact with said triggering device;

a guide means consisting of guide openings in covers of said gun trigger assembly, said guide openings interacting with a fourth pivot pin which extends through an aperture in said second linkage;

so that during a first stage said sear moves from an initial fixed position along a vertical axis of said first and second pivot pins to a state of clockwise rotation initiated by actuation of said triggering device which results in a break in alignment of said first and second linkages along horizontal axis of said second, third, and fourth pivot pins;

and during a second stage said sear temporarily realigns with said vertical axis of said first and second pivot pins;

entering a third stage said sear is pushed counterclockwise by said firing pin, said sear eventually being restored to said fixed position of said first-stage.

2. The gun trigger assembly of claim 1 wherein said first stage consists of said sear maintained in said initial fixed position by a counterforce of said spring means against said second linkage, firmly placing said fourth pivot pin against rear of said guide openings.

3. The gun trigger assembly of claim 1 wherein simple operation, positioning, and a tapered end of said sear allow said sear to be directly engageable with said firing pin, enabling said gun trigger assembly to be freely mounted and dismounted by the use of two screws on said underside.

4. A gun trigger assembly which can be freely mounted and dismounted on an underside of a main body of a gun equipped with a spring-loaded retractable firing pin or piston, comprising:

a first stage of operation in which a sear having a first pivot pin and a second pivot pin aligned on a vertical axis prior to rotation, rotates while taking said first pivot pin as a fulcrum, rotation of said sear substantially accelerated by an oppositional force of said firing pin or piston, said rotation of said sear occurring only after an alignment of a shared axis of multiple pivot pins arranged on multiple linkages is broken, said multiple pivot pins consecutively arranged with said multiple linkages such that prior to said rotation said second pivot pin shares said vertical axis with said first pivot pin and shares said shared axis with said multiple pivot pins and is connected to one of said multiple linkages which has one of said multiple pivot pins which in turn is connected to another of said multiple linkages within which is arranged another of said multple pivot pins;

a second stage of operation during which said sear recovers said vertical axis of said first and second pivot pins through a spring attached to one of said multiple linkages;

a third stage of operation in which said sear interlocks with said firing pin or piston when 1) said sear is pushed by said firing pin or piston accompanying a recovery of said firing pin, 2) a guide means located on said trigger assembly allows said multiple pivot pins to break out of said shared axis, moving said second pivot pin, which leads to a break in said vertical axis such that said sear rotates, and 3) said sear rotates on said first pivot pin, engaging with said firing pin.

5. A gun trigger assembly freely mountable and dismountable on an underside of a main body of a gun equipped with a spring-loaded retractable firing pin, comprising:

a first stage of operation in which a sear is initially directly engaged with a firing pin, said sear having a first pivot pin rotatable backward and forward and a second pivot pin which regulates said first pivot pin, said first pivot pin and said second pivot pin placed along a vertical axis, said sear rotating only after alignment of a shared axis of multiple pivot pins is broken, said multiple pivot pins consecutively arranged along with multiple linkages such that said second pivot pin is connected to one of said multiple linkages which has one of said multiple pivot pins which in turn is connected to another of said multiple linkages within which is arranged another of said multiple pivot pins, so that said multiple pivot pins and said multiple linkages connect along a horizontal axis in relation to said vertical axis of said first and second pivot pins, said horizontal and vertical axes having said second pin as a meeting point rotation of said sear initiated by a trigger actuated such that one of said multiple pivot pins is pushed downwardly, said sear using said first pivot pin as a fulcrum when said sear rotates, initial rotation of said sear substantially accelerated by an oppositional force of said firing pin;

a second stage of operation during which said sear automatically recovers to said vertical axis through a spring attached to one of said multiple linkages;

a third stage of operation in which said sear interlocks with said firing pin when 1) said sear is pushed by said firing pin accompanying recovery of said firing pin, 2) one of said multiple pivot pins slides within a guide means and said sear rotatably retreats, said sear rearwardly rotating on said first pivot pin and interlocking with said firing pin.

6. The gun trigger assembly of claim 5 wherein simple positioning and a tapered end of said sear directly engageable with said firing pin makes it possible for said gun trigger assembly to be freely mounted and dismounted by the use of two screws on said underside of said main body.

7. The gun trigger assembly of claim 5, wherein during said second stage of operation, after said break in alignment of said first stage, continuation of said rotation of said sear results in sufficient pivoting of one of said multiple linkages such that said spring is pulled until said spring rebounds sufficiently to temporarily return said multiple pivot pins and said multiple linkages to said horizontal axis, which action returns said sear to said vertical axis.

* * * * *